United States Patent [19]

Musolino

[11] 4,146,233

[45] Mar. 27, 1979

[54] GAME BOARDS AND CODED MARKERS THEREFOR

[76] Inventor: Nicholas J. Musolino, 1162 State St., Youngstown, Ohio 44506

[21] Appl. No.: 864,925

[22] Filed: Dec. 27, 1977

[51] Int. Cl.[2] ..... A63F 3/00

[52] U.S. Cl. ..... 273/236; 273/148 A; 273/290

[58] Field of Search ..... 273/236, 271, 282, 290, 273/148 R, 148 A

[56] References Cited

U.S. PATENT DOCUMENTS

| | | | |
|---|---|---|---|
| 1,656,993 | 1/1928 | Searle | 273/148 R |
| 1,730,640 | 10/1929 | Brownell | 273/148 R X |
| 1,825,673 | 10/1931 | Latimer | 273/236 |
| 3,363,902 | 1/1968 | Jones | 273/290 X |

FOREIGN PATENT DOCUMENTS

| | | | |
|---|---|---|---|
| 412365 | 6/1934 | United Kingdom | 273/148 R |

*Primary Examiner*—Anton O. Oechsle
*Attorney, Agent, or Firm*—Webster B. Harpman

[57] ABSTRACT

A pair of game boards are used in playing a card game and arranged to show the cards played through the use of a plurality of markers identified with the cards played. The boards are arranged to receive the markers in different colored sections in horizontal and vertical rows. The markers are positioned on the boards by each of the players to indicate the players score as controlled by the play or plays the player may make with the cards that are dealt to or drawn by the player. The markers have different values corresponding with the cards they represent and the players final score is determined by the markers and their positioning on the game boards.

8 Claims, 15 Drawing Figures

GAME BOARDS AND CODED MARKERS THEREFOR

BACKGROUND OF THE INVENTION (1) Field of the Invention

This invention relates to game boards on which indicators may be positioned in simulating card games.

(2) Description of the Prior Art

Prior game boards of this type have been used in simulating card games and in indicating and recording plays made in a card game. See for example U.S. Pat. Nos. 1,825,673 and 2,542,870.

In the first of these patents, a game board is disclosed which employs markers to show the cards held by the players and for indicating and recording the plays made. The present invention positions markers responsive to the cards played in a game and arranges the markers to provide additional scoring opportunities.

The second of the above patents discloses a board having four sections and a plurality of markers and by which a game of auction bridge may be simulated. The present invention primarily provides scoring indicators and arranges the indicators so that their location affects the score.

SUMMARY OF THE INVENTION

Game boards are disclosed which have different colored sections indicating different values and horizontal and vertical rows of marker receiving configurations identified with the suits of playing cards. One of the colored sections is red and shows the four through nine cards of each suit. Another section is white and shows the ten, jack, queen and king card of each suit and the final section is blue and shows only the ace card of each suit. The marker receiving configurations thus extend horizontally to provide locations for markers representing the four through ten, jack, queen, king and ace cards and the configurations extend vertically indicating the four suits, hearts, spades, diamonds and clubs. The different colored sections provide an opportunity for assigning different values to the different marker receiving configurations in each of the red, white and blue areas. The markers used on the game boards are engagable in the marker receiving configurations and the portions of the markers engaging the marker receiving configurations are identified by three colors, yellow, black and white, while the upper or outer portions of the markers have matching or different colors or indicia. Some of the markers are arranged for superimposed interlocking relationship. Additional markers are provided to indicate additional jokers in the card game.

DESCRIPTION OF THE PREFERRED EMBODIMENT

Figure 1:
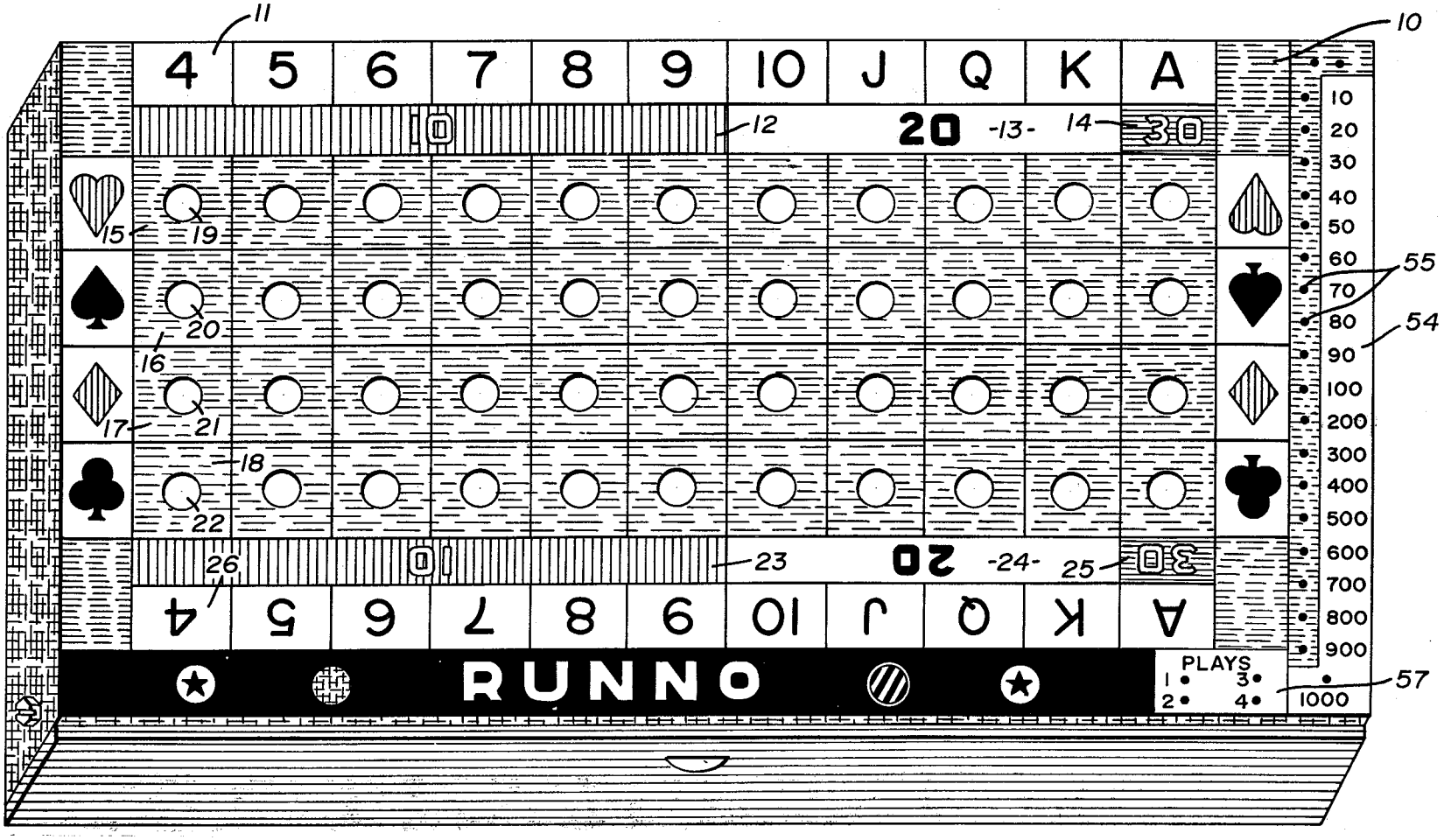
FIG. 1 is a perspective view of one of the game boards, two of which are used.

By referring to FIG. 1 of the drawings, it will be seen that one of the two game boards used in playing a game entitled "RUNNO" is illustrated and that it has an elevated top 10 of a length greater than its width. Indicia positioned along the upper longitudinal edge of the board 10 as seen in FIG. 1 comprises the representations of the playing cards four through 10, jack, queen, king and ace. The row of indicia is generally indicated at 11 and immediately below the same an elongated stripe is formed comprising a red stripe 12, a white stripe 13 and a blue stripe 14. The numeral 10 is superimposed on the red stripe 12, the numeral 20 is superimposed on the white stripe 13 and the numeral 30 is superimposed on the blue stripe 14. There are four elongated rows arranged in side by side relation to one another, the rows being generally indicated by the numerals 15, 16, 17 and 18 and they are marked off in a plurality of squares and each of the squares has an opening 19, 20, 21 and 22 respectively therein. There are as many openings 19 in the row 15 as the number of cards indicated in the row 11. In other words a total of 11 squares which correspond with the card numbers 4 through 10 and the jack, queen, king and ace of row 11.

At each end of the rows 15, 16, 17 and 18 indicia comprising representations of hearts, spades, diamonds and clubs appear and it will be observed that they are arranged so that they appear in correct formation at the left end of the board as seen in FIG. 1 and in upside down relation on the right end of the board as seen in FIG. 1. It will also be seen that a second series of red, white and blue stripes 23, 24 and 25 are arranged in end to end relation and adjacent the row 18 in which the openings 22 are located. The numerals 10, 20 and 30 appear on the stripes 23, 24 and 25 and are upside down with respect to the view seen in FIG. 1. Adjacent the stripes 23, 24 and 25 there is a secondary row 26 in which the numerals 4 through 9 and the letters J, Q, K and A appear to represent the cards 4 through ten and the jack, queen, king and ace and these are arranged in upside down relation to the point of view if FIG. 1 of the drawings.

It will be seen that these letters and the numerals in the colored stripes 23, 24 and 25 are thus arranged for correct viewing by a player on the opposite side of the board and that the same accommodation is provided by the oppositely arranged representations of the hearts, spades, diamonds and clubs heretofore referred to.

Figure 2:
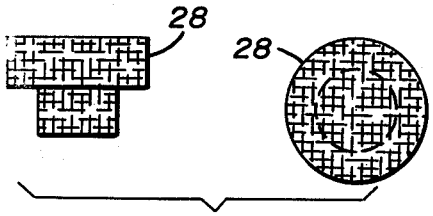
FIG. 2 is a side elevation and a top plan view of one of the yellow markers.
Figure 6:
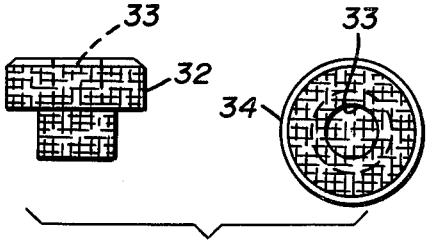
FIG. 6 is a side elevation and a top plan view of a modified yellow marker.
Figure 3:
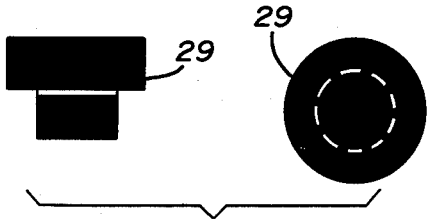
FIG. 3 is a side elevation and a top plan view of one of the black markers.
Figure 7:
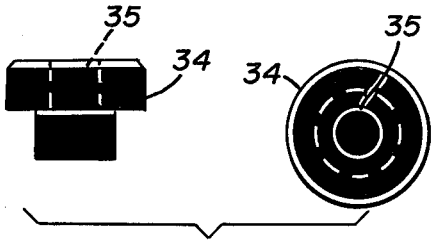
FIG. 7 is a side elevation and a top plan view of a modified black marker.
Figure 4:
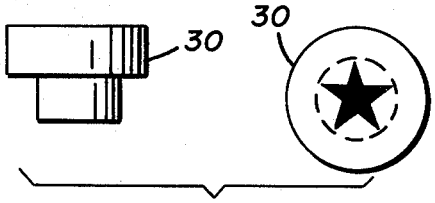
FIG. 4 is a side elevation and a top plan view of one of the white markers.
Figure 8:
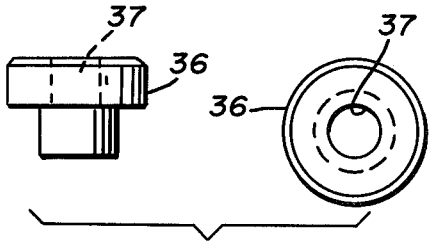
FIG. 8 is a side elevation and a top plan view of a modified white marker.
Figure 5:
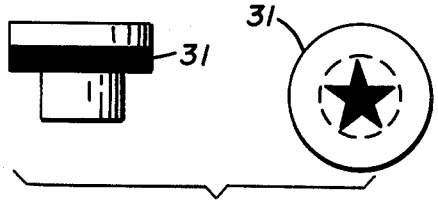
FIG. 5 is a side elevation and a top plan view of one of the black and white markers.
Figure 9:
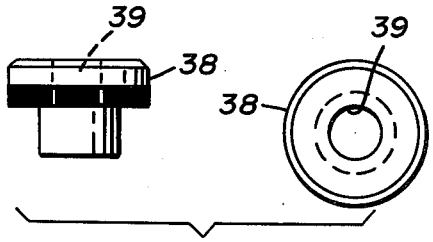
FIG. 9 is a side elevation and a top plan view of a modified white and black marker.
Figure 10:
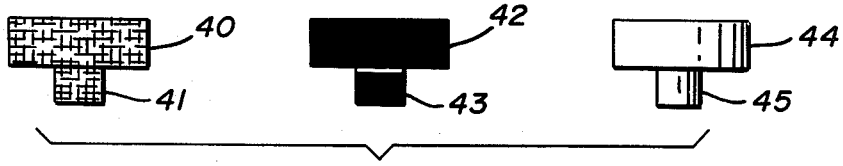
FIG. 10 comprises side elevations of yellow, black and white markers further modified to be engagable in the markers illustrated in FIGS. 6–9.

By referring now to FIGS. 2–13 it will be seen that a plurality of different colored markers are illustrated and that in FIG. 2 of the drawings a side elevation and a top plan view of a yellow colored marker 28 may be seen. In FIG. 3 a black colored marker 29 is illustrated and in FIG. 4 a white colored marker 30 is illustrated. In FIG. 5 the marker 31 is white on top with a black lower body and a star indicia on its uppermost surface. In FIG. 6 a modified form of marker 32 may be seen, it is yellow colored and it has an opening 33 centrally of its uppermost surface. In FIG. 7 a black colored modified marker 34 is illustrated and it has a central opening 35 and in FIG. 8 a white colored modified marker 36 is illustrated and it has a central opening 37. In FIG. 9 the modified marker is indicated at 38 and it has a central opening 39. In FIG. 10 of the drawings, three side elevations of three markers which are further modified may be seen. The first of these is a yellow modified marker 40 and it has a depending stem 41 which is of a size that will register in the opening 33 of the marker 32 seen in FIG. 6 and heretofore described. The black modified marker in FIG. 10 is generally indicated at 42 and it has a modified stem 43 which will register in the opening 35 in the black marker 34 of FIG. 7 and the white modified marker in FIG. 10 is indicated at 44 and it has a modified stem 45 which will register in the opening 37 in the white marker 36 of FIG. 8.

By referring again to the markers illustrated in FIGS. 2–9, it will be observed that each of them has an enlarged top portion and a smaller base or stem and this smaller base or stem is of a size which will register in any one of the openings 19, 20, 21 and 22 in the rows 15–18 of the game board seen in FIG. 1 of the drawings. The markers are color coded as hereinbefore described to control the positioning of the same on the game board of FIG. 1. The yellow stem markers are always used in the rows of openings 19–22 while the markers with black stems are used only in the openings 19–22 running from top to bottom of the board as seen in FIG. 1 of the drawings. The white stemmed markers are used to indicate five additional jokers that are added to two regular decks of fifty-two playing cards each from which the deuces and treys have been removed so that the playing cards used in the game played on and scored on the game boards herein disclosed corresponds with the indicia of the game boards as hereinbefore described.

Figure 11:
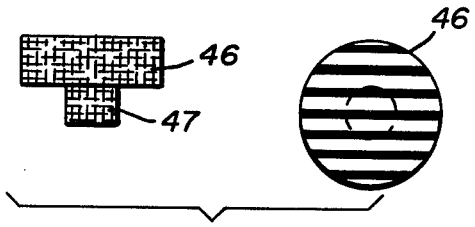
FIG. 11 is a side elevation and a top plan view of a yellow marker having a striped top.
Figure 12:
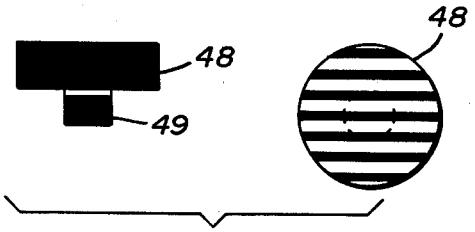
FIG. 12 is a side elevation and a top plan view of a black marker having a striped top.
Figure 13:
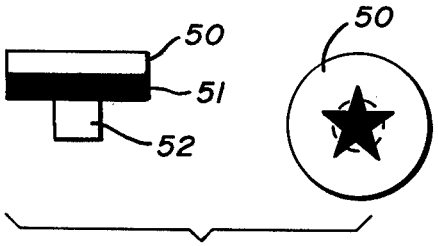
FIG. 13 is a side elevation of a black and white marker having a white top and a star design.

By referring now to FIGS. 11, 12 and 13 of the drawings, it will be observed that the modified markers disclosed therein are similar to those of FIG. 10 and heretofore described and particularly with respect to their formation with smaller stems than the markers for example illustrated in FIGS. 2–9 of the drawings heretofore described.

In FIG. 11 a yellow marker 46 has a relatively small diameter stem 47 and the top of the marker 46 is striped as seen in the top plan view which is part of this composite illustration. In FIG. 12 of the drawings the black marker 48 has a small stem 49 and the top of the marker 48 is striped as seen in the top plan view of this composite illustration.

In FIG. 13 a marker 50 has a white top, a black lower or intermediate section 51 and a small white stem 52. A star appears on the top as seen in the top plan view which is part of this composite illustration.

It will be observed that the markers 40, 42 and 44 of FIG. 10 and the markers 46, 48 and 50 of FIGS. 11, 12 and 13 all have the same small sized stems and that these are registrable in the openings formed in the other markers 32, 34, 36 and 38 and specifically in the openings 33, 35, 37 and 39 therein as seen in FIGS. 6–9 of the drawings and heretofore described.

Figure 15:
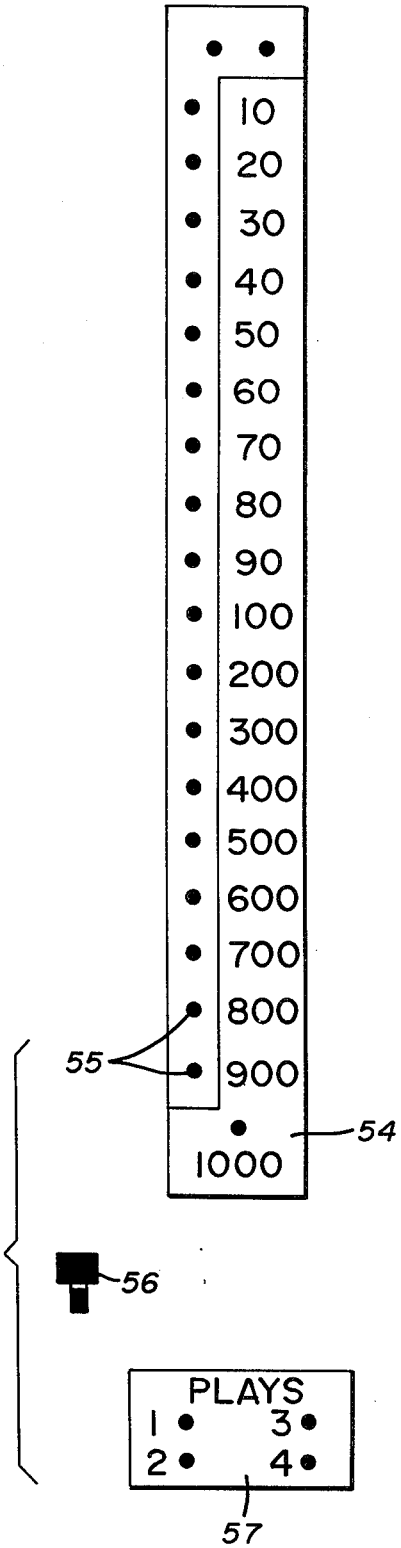
FIG. 15 is an enlarged detail of the scoring section of the board seen in FIG. 1 and includes a side elevation of one of the scoring markers usable therewith.

By referring to FIGS. 1 and 15 of the drawings it will be seen that a scoring column 54 is positioned on the extreme right hand end of the game board of FIG. 1 and includes numerals indicating scores that may be achieved and these are adjacent small openings 55 in which scoring markers 56 may be positioned. Additionally a counter panel 57 is provided and the scoring markers 56 can be used to indicate the plays 1–4 thereof.

Figure 14:
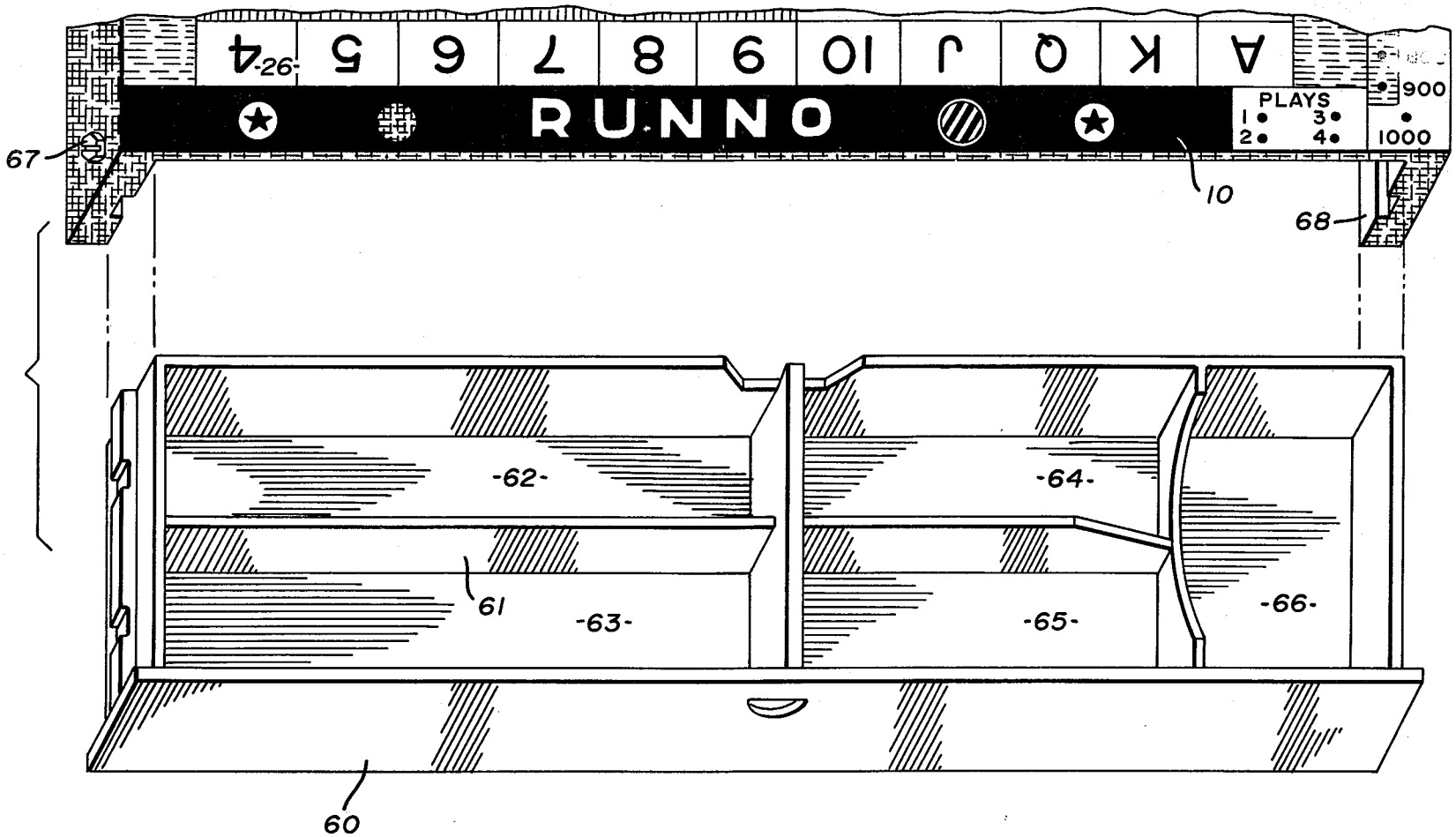
FIG. 14 is a perspective view of a portion of the game board of FIG. 1 with parts broken away and illustrated a compartmented drawer which forms part of the game board of FIG. 1.

By referring now to FIG. 14 of the drawings, a drawer 60 is illustrated and it will be seen that it is provided with a plurality of longitudinal and transverse partitions 61 which divide the same into a plurality of compartments 62, 63, 64, 65 and 66 respectively. The compartments 62–65 provide convenient places for the storage of the markers hereinbefore referred to and the compartment 66 is arranged to receive the playing cards heretofore referred to. The drawer 60 is slidably mounted in the base of the playing board 10, the base being formed of depending sides 67 and 68 and a back wall, not shown.

In order that the utility of the game boards disclosed herein can be appreciated, a description of a game of RUNNO played thereon with the playing cards referred to hereinbefore will now be given. There are two boards and two players or four players can play. Four players form two partnerships. The object of the game played on the board is to score horizontally and vertically with the markers in the openings 19–22. The game deals with runs, sets, sequences, horizontal lines, vertical lines, groups, jokers, etc. The horizontal lines referred to are the elongated lines of openings 19–22 and the vertical lines referred to are those extending from top to bottom of the board as seen in FIG. 1 and extending between the playing card numbers for example from 4 to 4 or from 8 to 8 or from jack to jack, etc. To score horizontally only runs or sequences of at least three cards in length or more in the same suit enable the corresponding markers to be placed on the board. A three card sequence must always have two natural card when scoring it with a joker. To score vertically only sets or groups are required. A set means at least three cards of the same rank and such a set must always be scored with three natural cards and always showing three different suits. An object of a game playable on the game boards is to attempt to complete the easier horizontal lines for bonus points and/or to try to out-score the opponents in two hands of play to win the game.

Assuming four players, the dealer deals 7 cards clockwise to each player and the remaining cards are placed face down between the boards to form the stock of cards for drawing. The player to the left of the dealer starts the game by drawing the top card from the stock, then if he chooses and he has the cards in his hand, he can score on his board any plays that he may have with the proper markers Whether he plays or not he always makes a discard and the next player in turn can take this discard or draw a card from the stock. The yellow stem markers are always used for horizontal plays the black stem markers are used for vertical plays and the white stem markers, which as hereinbefore described represent the jokers, score any card either horizontally or vertical except the aces. The yellow and black markers which result when the markers of FIG. 10 are superimposed on the markers of FIGS. 6–9 indicate that the same natural card was scored once horizontally and once vertically. Whenever the same natural card is scored twice horizontally, then the marker with the yellow stem and a striped top as in FIG. 11 is used and scored in superimposed relation on the yellow stemmed marker. Whenever the same natural card is scored twice vertically then the black stem striped marker is used and scored on the black marker. After the game has been played by the participation of all of the players, the total of the captured aces and jokers are deducted from the boards, each side then counts the remaining markers. Extra bonus points, if any, as a result of a completed horizontal line are added to the marker total. Since the plays which resulted from the use of the playing cards are indicated by the markers on the board, the scoring is based on the markers with the arrangement of the markers adding bonus points to the count attributed to them by their location in the openings 19–22 in the areas of the multi-colored stripes 12, 13 and 14.

It will thus be seen that by using the game boards disclosed herein and playing a card game very much like rummy, a new game is possible and that the players by playing the desired cards in their hands in a desired order can position the markers in positions on the playing board where bonus points as well as scores for completed lines, etc. can be achieved.

It will thus be seen that playing boards on which an interesting and attractive game can be played in conjunction with regular playing cards has been disclosed and that the action in the game, the scoring in the game and the visible display of the scoring in the game provides a new and novel arrangement dependent on the configuration of the playing boards and the color coding and mechanical inter-engagement of the plurality of markers which are used.

Although but one embodiment of the present invention has been illustrated and described, it will be apparent to those skilled in the art that various changes and modifications may be made therein without departing from the spirit of the invention and having thus described my invention what I claim is:

1. Game boards on which a game played in combination with conventional playing cards may be played and scored comprise boards, each having a top portion with four longitudinal extending rows of openings arranged in parallel relation therein and indicia at at least one of the ends of said rows identifying the four rows with the suits of the playing cards and secondary indicia arranged in parallel relation to the rows of openings identifying the values of the playing cards, the secondary indicia arranged to correspond with each of the openings in each of the parallel rows of openings, at least one multi-colored stripe arranged in parallel relation to said rows of openings, said multi-colored stripe including three non-coextensive longitudinally extending sections and scoring value indicia superimposed on each said section, a plurality of markers, some of which have a portion registrable in one of said openings, said markers being coded to require their positioning along with similarly coded markers either in a row of said openings or in a group of said openings perpendicular to said rows.

2. The game boards set forth in claim 1 and wherein each of said four longitudinally extending rows of openings include eleven openings and wherein the secondary indicia arranged in parallel relation thereto comprises the numerals 4–10 inclusive and the letters J, Q, K and A.

3. The game boards set forth in claim 1 and wherein the indicia at one of the ends of said rows identifying the rows tih the suits of the playing cards is repeated at the other end of the rows and wherein said repeated indicia appears in reverse relation to the indicia at said one end.

4. The game boards set forth in claim 1 and wherein said secondary indicia arranged in parallel relation to the rows of openings and identifying the values of the playing cards is positioned on one longitudinal side of said rows of openings and wherein a duplicate secondary indicia is arranged on the opposite side of said parallel rows of openings.

5. The game boards set forth in claim 1 and wherein said one multicolored stripe in parallel relation to said rows of openings in positioned along one longitudinal side of said rows of openings and a second multicolored stripe is positioned along the opposite longitudinal side of said parallel rows of openings.

6. The game boards set forth in claim 1 and wherein said plurality of markers each have enlarged upper portions and depending stem portions and wherein said markers are coded with different colors, one of said different colors requiring the positioning of the markers carrying that color in horizontal arrangement in one of said longitudinally extending rows of openings and wherein markers of a different color require the positioning thereof crosswise of said four longitudinally extending rows of openings.

7. The game boards set forth in claim 1 and wherein selected ones of said markers have openings in one of their surfaces and wherein additional markers have stems arranged for registry in said openings in said selected markers.

8. The game boards set forth in claim 7 and wherein said markers having portions engagable in openings in selected ones of said markers are provided with secondary coding to require their positioning in openings in said selected markers and whereby different values can be attributed to said markers, said selected markers, said additional markers and combinations of the same.

* * * * *